United States Patent [19]

Serpa

[11] Patent Number: 4,496,013

[45] Date of Patent: Jan. 29, 1985

[54] PREVENTION OF CONE SEAL FAILURES IN ROCK BITS

[75] Inventor: Richard E. Serpa, Arcadia, Calif.

[73] Assignee: Smith International, Inc., Newport Beach, Calif.

[21] Appl. No.: 410,428

[22] Filed: Aug. 23, 1982

[51] Int. Cl.[3] ..... E21B 10/08

[52] U.S. Cl. ..... 175/374; 175/327

[58] Field of Search ..... 175/315, 331, 327, 374, 175/409, 410, 411, 422; 166/244 C, 242, 243, 65 R; 204/147

[56] References Cited

U.S. PATENT DOCUMENTS 2,466,239 4/1949 Holcombe ..... 166/244 C
3,251,427 5/1966 Ewing ..... 175/320

FOREIGN PATENT DOCUMENTS 491774 4/1978 Australia ..... 204/147
578420 10/1977 U.S.S.R. ..... 175/331

*Primary Examiner*—James A. Leppink
*Assistant Examiner*—Michael Starinsky
*Attorney, Agent, or Firm*—Christie, Parker & Hale

[57] ABSTRACT

There is provided a rock bit comprising a bit body having a dome and a plurality of legs, each with a journal pin. A cutter cone is mounted on each journal pin with a cone seal between the journal pin and cutter cone. A sacrificial anode is attached to the dome of the bit body having a shape for diverting flow of drilling mud around the cutter cones. Preferred shapes of the sacrificial anode include inverted cones and tetrahedrons. The sacrificial anode prevents cone seal failures caused by corrosion of the bit body adjacent the cone seals.

16 Claims, 5 Drawing Figures

PREVENTION OF CONE SEAL FAILURES IN ROCK BITS

FIELD OF THE INVENTION

This invention relates to a technique for reducing cone seal failure in steel rock bits and more particularly to a process for the reduction of rock bit corrosion causing such cone seal failures.

BACKGROUND OF THE INVENTION

Heavy duty rock bits are employed for drilling wells in subterranean formations for oil, gas, geothermal steam and the like. Such bits have a body connected to a drill string comprising a plurality, typically three, of legs and a hollow cutter cone mounted on each leg for drilling rock formations. The cutter cones are mounted on steel journal pins integral with the lower end of each leg of the bit body.

The cutter cones are maintained on the journal pins and provided rotatable movement thereon by bearings. The bearings are lubricated with a special grease adapted to conditions encountered by the drill bit. The grease is prevented from leaking by an O-ring cone seal positioned at the base of the journal pin between the cutter cone and the juncture of the journal pin and the bit body. The cone seal also prevents foreign material from being introduced between the cutter cone and journal pin.

In use the drill string and bit body are rotated in the bore hole and each cone is caused to rotate on its respective journal pin as the cone contacts the bottom of the bore hole that is being drilled. High pressures and temperatures are encountered as such rock bits are used in hard, tough formations. The total useful life of a rock bit in such severe environments is on the order of 20 to 200 hours for bits in sizes of about 6½ inch to about 12¼ inch diameter at depths of about 5,000 feet to about 20,000 feet. Useful lifetimes of about 65 hours to about 150 hours are typical.

When a rock bit wears out or fails as a bore hole is being drilled, it is necessary to withdraw the drill string for replacing the bit. The amount of time required to make a round trip for replacing a bit is essentially lost from drilling operations. This time can become a significant portion of the total time for completing a well, particularly as the well depths become great. It is therefore desirable to maximize the lifetime of a drill bit in a rock formation. Prolonging the time of drilling minimizes the lost time in "round tripping" the drill string for replacing bits.

Replacement of a drill bit can be required for a number of reasons, including wearing out or breakage of the structure contacting the rock formation. One reason for replacing the rock bits includes failure or severe wear of the bearings on which the cutter cones are mounted. These bearings are subject to very high pressure drilling loads, high hydrostatic pressures in the hole being drilled, and high temperatures due to drilling, as well as elevated temperatures in the formation being drilled. Considerable development work has been conducted to produce bearing structures which employ materials that minimize wear and failure of such bearings.

Excessive wear and failure of bearings can also be caused by lubrication failures which can be attributed to misfit of bearings and cone seal failures, as well as problems with the lubricating grease.

It has recently been discovered that in certain geographical regions, particularly in the Midwest region of the United States, there is an abnormally high failure rate of rock bits due to failure of the cone seals. Failure of the cone seals allows lubricating grease to escape and permits drilling mud or the like to enter the bearings. Such materials are abrasive and quickly damage the bearings. Neither the cause of the cone seal failures nor a solution to the problem has heretofore been established.

SUMMARY OF THE INVENTION

There is provided a technique for preventing cone seal failures caused by abrasive wear of the cone seal against the portion of each leg of a rock bit adjacent the uppermost portion of each journal pin. It has been discovered that this location is highly susceptible to corrosion pitting and corrosion cracking.

The technique comprises attaching a sacrificial anode to the exterior surface of the rock bit, preferably in the dome region of rock bit, so that the anode is in electrical contact with the bit body.

The anode preferably comprises at least one metal selected from the group consisting of zinc, magnesium, aluminum and alloys thereof and is preferably selected from the group consisting of zinc and zinc alloys.

It is presently preferred that attachment of the anode be made in the dome region of the rock bit and that the general shape of the anode be that of an inverted tetrahedron or cone.

In a preferred embodiment, the means for attaching the anode to the rock bit includes attaching a threaded metal stud to the dome region of the rock bit so that the stud extends downward from the dome region, generally along the vertical axis of the rock bit. In a particularly preferred embodiment, the stud is attached to a metal plate which is welded to the dome region. The anode comprises a corresponding threaded hole enabling it to be screwed onto the stud. This embodiment allows easy attachment and removal of the anode from the rock bit.

In a second preferred embodiment, the dome region comprises an indentation or an inverted metal receptacle welded onto the dome region. The rock bit is inverted and the metal of the anode is cast into the indentation or the receptacle.

BRIEF DESCRIPTION OF THE DRAWINGS

These and other features and advantages of the present invention will be better understood by reference to the following detailed description when considered in conjunction with the accompanying drawings wherein.

DESCRIPTION OF THE INVENTION

Figure 1:
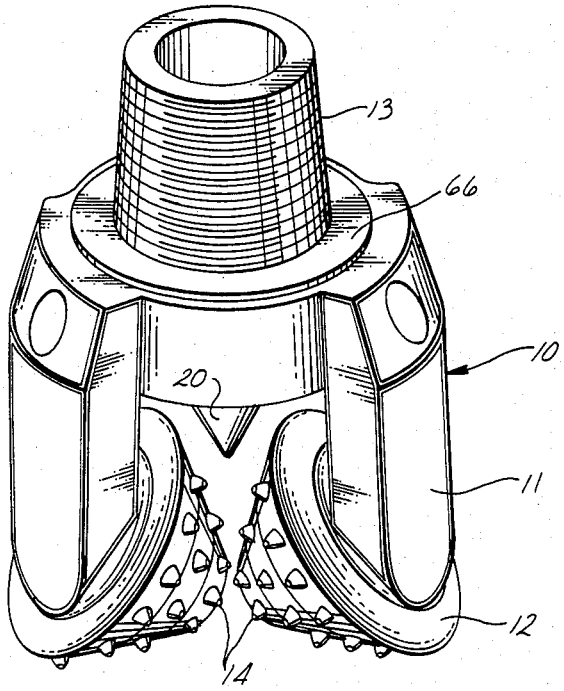
FIG. 1 is a semi-schematic perspective view of a preferred rock bit.

In accordance with the present invention, there is provided a technique for reducing cone seal failure in steel rock bits. The technique comprises attachment of a metal anode, comprising a metal less noble than the metal of the rock bit, to the surface of the rock bit so that the metal anode is in electrical contact with the body of the rock bit and serves as a sacrificial anode during corrosion.

It has been discovered that the heretofore unknown cause of certain cone seal failures in rock bits is abrasive wear of the O-ring cone seal against a rough surface on the portion of each leg of the rock bit body in contact with the uppermost portion or top of the cone seal. The wear causes localized stretching and erosion of the cone seal as the cutter cone rotates. The stretched and eroded portions of the cone seal have a reduced cross-sectional area and allow drilling mud and other foreign material to enter the bearings. It has further been found that the roughness of the bit body at this location is the result of corrosive attack in the form of pitting and cracking.

This is a highly unexpected finding for several reasons. During drilling, a special drilling mud is continually circulated down through the drill string and through nozzles in the rock bit. The mud then circulates up around the exterior of the rock bit and drill string, carrying rock chips and debris away from the rock bit. The mud itself is generally slightly alkaline, has low conductivity and generally contains corrosion inhibitors. All of these factors tend to make the mud non-corrosive to steel rock bits.

In addition, the corrosion sites causing the cone seal failures are in the dome region of the rock bit, i.e., the region between and above the cutter cones. This region receives relatively little agitation from the circulating drilling mud as compared to the exterior surfaces of the rock bit. Because of the reduced agitation, a lower corrosion rate would be expected, if corrosion were to take place, than in a region of higher agitation.

Pitting corrosion is a form of localized corrosion. The attack is limited to extremely small areas of the metal surface while the rest of the surface is not similarly affected. Pits enlarge with time but the increase is in depth and volume rather than surface area.

Steel, like pure metals, will corrode if the oxidation potential of the steel is more positive at one point than it is at another point and if at the same time the reduction potential for a cathodic reaction, e.g., oxygen reduction, is more positive at a certain site on the metal than at another site.

There are many possible causes for the onset of corrosion pitting. However, in all cases, there is either an abnormal anodic site which makes the normal surface cathodic or an abnormal cathodic site which makes the normal surrounding surface anodic. Typical factors involved in the onset of pitting include localized scratches or abrasions or differential composition or concentration of the environment.

While not being bound by theory, it is believed that a combination of factors result in the onset of corrosion pitting at this particular location, i.e., the portion of each leg of the bit body in contact with the top of each cone seal. First, due to the extreme pressure, the lower portion of each leg of the rock bit undergoes constant flexing during use. Each flexure is accommodated by the leg at its upper end. Along the inner side of the leg, i.e., the side of the leg nearest the vertical axis of the rock bit, the flexure is accommodated over a very small area adjacent the uppermost portion of the journal pin. This is the same portion of each leg in contact with the top of the cone seal. The constant flexing possibly alters the metallurgy of the rock bit at this location.

Each flexure is also accommodated by the leg at its upper end over a much larger area along its outer side, i.e., the side of the leg farthest from the vertical axis of the rock bit, and hence, the metallurgy of the rock bit along the outer side of each leg is affected to a much lesser degree. This area does not display a significant increase in corrosion attack.

The continual changes in stress on the portion of each leg in contact with the top portion of each cone seal is believed to make the metal at this location more susceptible to pitting corrosion. In addition, once pitting has initiated, continual flexing promotes the formation of fatigue and corrosion cracks.

In addition, it has been found that most cone seal failures due to such pitting corrosion occur in environments having a high carbon dioxide concentration. It is theorized that carbon dioxide dissolves in the drilling mud and forms carbonic acid. The carbonic acid concentration increases to a level sufficient to initiate attack on the metal of the rock bit at these locations which is more susceptible to corrosion due to flexing.

Once initiated, corrosion pits propagate by local cell action. As the cavity grows, it tends to accumulate a cap or crust of insoluble corrosion products which restricts the amount of oxygen supplied to the cavity. The anodic reaction of metal dissolution tends to decrease the local pH. This generates an oxygen-lean, acidic region in the pit where metal dissolution is favored.

Cathodic reactions, e.g., oxygen reduction, tend to increase the local pH of the electrolyte. This generates a comparatively oxygen-rich, alkaline region over the rest of the metal surface where cathodic reactions such as oxygen reduction is favored. The localized differences in pH and oxygen concentration tend to exacerbate the propagation of the corrosion pits. Thus, corrosion pits tend to grow in a downward direction rather than laterally as this is the area with the highest acidity and lowest oxygen concentration.

To reduce or eliminate rock bit corrosion adjacent the cone seals and thereby prevent cone seal failures, a sacrificial anode is attached to the dome of the rock bit. Attachment is made on the dome to minimize the distance between the corroding portion of the rock bit and the sacrificial anode and because it provides the least erosive location for the sacrificial anode because of the relatively low amount of agitation and abrasive contact with rock formation.

When a metal such as steel corrodes, it undergoes an anodic oxidative reaction wherein metal atoms lose electrons and form metal ions. The electrons are accepted by a reactant in the simultaneous cathodic reduction reaction. The sacrificial anode prevents corrosion of steel by donating electrons more readily to the cathodic reaction than steel. Because of this, the sacrificial anode undergoes oxidation rather than the steel of the rock bit.

Metals which may be used as a sacrificial anode include those metals which are less noble than the metal of the rock bit, which is generally steel. As used herein, "less noble" metals refers to metals having oxidation potentials more positive than the metal of the rock bit, i.e., steel, and in which the difference in oxidation potentials is greater than the electrical resistance through those metals. For metals in contact and for short distances, the electrical resistance is essentially zero. Minimizing the electrical resistance is one reason for attaching the sacrificial anode close to the corrosion site.

The metal chosen for use as a sacrificial anode must be sufficiently strong to withstand stresses exerted on it during a drilling operation without becoming detached from the rock bit. Also, while being more reactive than the steel of the rock bit, the sacrificial anode must not be so reactive that it undergoes corrosion at an excessively rapid rate, thereby completely dissolving or dissolving sufficiently to become detached from its holder. For example, metals such as sodium and calcium are unsuitable because they are much too reactive.

Other metals, such as chromium, are unsuitable because, although more reactive than steel, they tend to form a tough, stable oxide film which inhibits further oxidation.

It is presently preferred that the sacrificial anode contain at least one metal selected from the group consisting of zinc, aluminum, magnesium and alloys of the same. For example, an aluminum alloy can be used for greater strength than pure aluminum. The presently preferred metals are zinc and zinc alloys.

Zinc and zinc alloys display the most preferred combination of reactivity, stability and strength. In addition, anodes of zinc and zinc alloys are easily fashioned and, if cast onto a steel surface, wet the surface, thereby assuring good electrical contact with the steel.

Zinc and zinc alloys are sufficiently less noble than steel to sacrificially undergo oxidation in place of steel. Zinc and zinc alloys are also sufficiently stable not to excessively corrode due to the environment during drilling and are strong enough not to significantly erode during drilling if attached to the dome of the rock bit.

Figure 2:
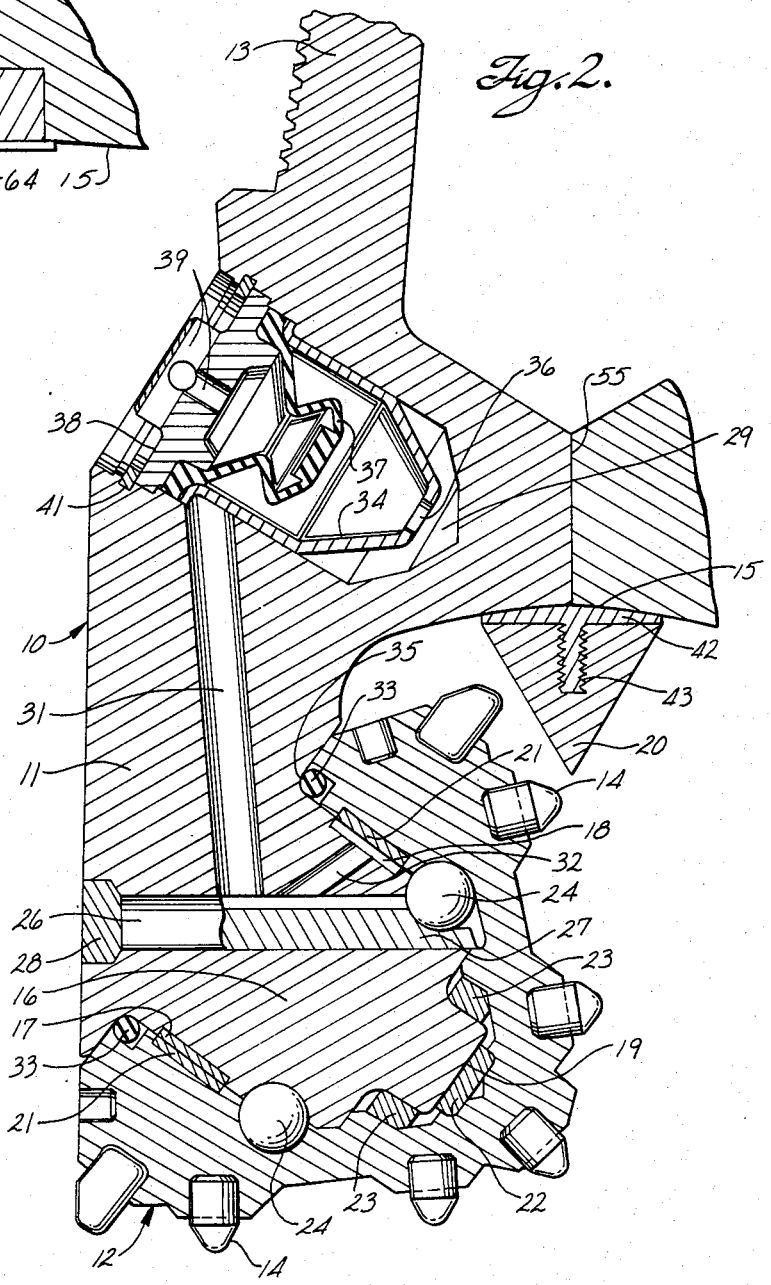
FIG. 2 is a partial cross-sectional view of a preferred rock bit.

A preferred rock bit comprising such a sacrificial anode is shown in FIG. 1 and FIG. 2 and comprises a body 10 having three legs 11, each with a cutter cone 12 mounted on its lower end. A threaded pin 13 is at the upper end of the body for assembly of the rock bit onto a drill string for drilling oil wells or the like. A plurality of tungsten carbide inserts 14 are provided in the surfaces of the cutter cones for bearing on the rock formation being drilled.

FIG. 2 is a fragmentary longitudinal cross section of the rock bit detailing one of the three legs 11 on which the cutter cones 12 are mounted. The legs are welded together along a Y-shaped seam 55 and form a dome 15 to which a sacrificial anode 20 is attached.

Each leg 11 includes a journal pin 16 extending downwardly and radially inwardly on the rock bit body. The journal pin includes a cylindrical bearing surface having a hard metal insert 17 on a lower portion of the journal pin. The hard metal insert is typically a cobalt or iron base alloy welded in place in a groove on the journal leg and having a substantially greater hardness than the steel forming the journal pin and rock bit body. An open groove 18 corresponding to the insert 17 is provided on the upper portion of the journal pin. Such a groove can, for example, extend around 60% of the circumference of the journal pin and the hard metal 17 can extend around the remaining 40%. The journal pin also has a cylindrical nose 19 at its lower end.

Each cutter cone 12 is in the form of a hollow, generally-conical steel body having tungsten carbide inserts 14 pressed into holes on the external surface. Such tungsten carbide inserts provide the drilling action by engaging a subterranean rock formation as the rock bit is rotated. The cavity in the cone contains a cylindrical bearing surface including an aluminum bronze insert 21 deposited in a groove in the steel of the cone or as a floating insert in a groove in the cone. The aluminum bronze insert 21 in the cone engages the hard metal insert 17 on the leg and provides the main bearing surface for the cone on the bit body. A nose button 22 is between the end of the cavity in the cone and the nose 19, and carries the principal thrust loads of the cone on the journal pin. A bushing 23 surrounds the nose and provides additional bearing surface between the cone and journal pin.

A plurality of bearing balls 24 are fitted into complementary ball races in the cone and on the journal pin. These balls are inserted through a ball passage 26 which extends through the journal pin between the bearing races and the exterior of the rock bit. A cone is first fitted on the journal pin and then the bearing balls 24 are inserted through the ball passage. The balls carry any thrust loads tending to remove the cone from the journal pin and thereby retain the cone on the journal pin. The balls are retained in the races by a ball retainer 27 inserted through the ball passage 26 after the balls are in place. A plug 28 is then welded into the end of the ball passage to keep the ball retainer in place.

The bearing surfaces between the journal pin and cone are lubricated by grease. Preferably the interior of the rock bit is evacuated and grease is introduced through a fill passage (not shown). The grease thus fills the regions adjacent the bearing surfaces plus various passages and a grease reservoir, and air is essentially excluded from the interior of the rock bit. The grease reservoir comprises a cavity 29 in the rock bit body which is connected to the ball passage 26 by a lubricant passage 31. Grease also fills the portion of the ball passage adjacent the ball retainer, the open groove 18 on the upper side of the journal pin and a diagonally extending passage 32 therebetween.

A pressure compensation subassembly is included in the grease reservoir 29. This subassembly comprises a metal cup 34 with an opening 36 at its inner end. A flexible rubber bellows 37 extends into the cup from its outer end. The bellows is held in place by a cap 38 having a vent passage 39 therethrough. The pressure compensation subassembly is held in the grease reservoir by a snap ring 41.

When the rock bit is filled with grease, the bearings, the groove 18 on the journal pin, passages in the journal pin, the lubrication passage 31 and the grease reservoir on the outside of the bellows 37 are filled with grease. If the volume of grease expands due to heating, for example, the bellows 37 is compressed to provide additional volume in the sealed grease system, thereby preventing accumulation of excessive pressures.

Grease is retained in the bearing structure by a resilient cone seal 33 in the form of an O-ring at the base of each journal pin between the cutter cone and journal pin. The cone seal 33 may be subject to excessive wear due to corrosion of the region 35 of the surface of the leg in contact with the uppermost portion of the cone seal. This is the same region along the inside surface of the leg that accommodates flexing of the leg during drilling.

To reduce or prevent corrosion attack on the region of the leg in contact with the cone seal, a sacrificial anode 20 is attached to the dome 15 of the rock bit. To attach the anode, a steel plate 42 having a threaded stud 43 extending downwardly, generally normal to the plate and generally along the vertical axis of the rock bit is welded to the dome 15 of the rock bit. A sacrificial anode 20, shown in the shape of an inverted cone, having a corresponding threaded hole, is threaded onto the stud 43.

Figure 3:
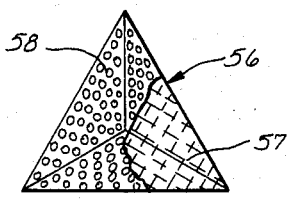
FIG. 3 is a bottom view of a preferred anode showing a protective cover partially cutaway.
Figure 4:
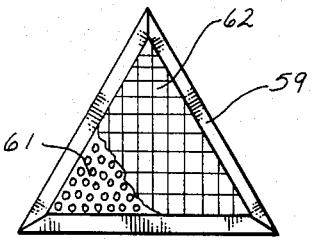
FIG. 4 is a bottom view of a preferred receptacle showing a reinforcing network and a protective cover partially cutaway.

An anode in the form of an inverted cone or more preferably, in the form of an inverted tetrahedron 56 as shown in FIG. 3 provides the benefit of diverting the flow of mud from the nozzles (not shown) of the rock bit around the cutter cones to better clean the cone surfaces of debris.

Anodes that can be threaded onto and off of such a permanently affixed threaded stud provide convenience. This arrangement allows the anode to be installed or removed at any location, e.g., at the drill site.

The strength and resistance to erosion of the anodes may be enhanced by providing the anode with an internal permeable reinforcing network or matrix 57 extending throughout the anode metal.

The anode may also be protected from erosion by providing the anode with a protective, permeable cover, such as a screen or perforated metal plate 58 shown partially cutaway in FIG. 3, preferably made of steel. Such a cover would prevent rocks and debris from contacting and causing wear of the anode.

In some rock bits, the proximity of the cutter cones prevents such a sacrificial anode from being threaded onto a stud attached to the dome after the legs of the rock bit have been assembled, i.e., welded together. For such rock bits, it is presently preferred that a metal "cup" or "receptacle" 59 be attached, e.g., by welding, in an inverted position to the dome. When the assembled rock bit is inverted, the receptacle provides a space into which the metal of the anode may be cast, i.e., heated to a liquid state and poured into the receptacle. The receptacle may have any suitable shape, such as a conical or triangular shape or the shape of the lower portion of a tetrahedron.

The receptacle is preferably made of metal, but may be made of a destructable material, such as a ceramic material which can be broken and removed once the anode has been cast in place. When using such a destructable material, both the top and bottom of the receptacle is open to allow the anode metal to be cast directly onto the metal of the bit, to thereby form a secure bond to it.

Figure 5:
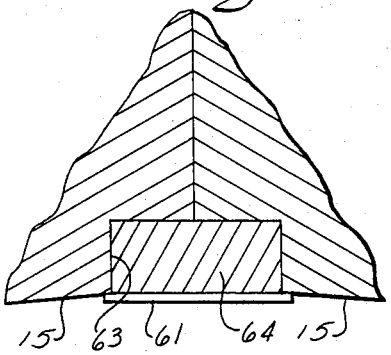
FIG. 5 is a fragmentary cross sectional view of the dome region of a rock bit showing an indentation into which anode metal has been cast.

An alternative to an inverted receptacle is to provide an indentation 63 in the dome as shown in FIG. 5 into which the anode metal 64 is cast.

An anode cast into such an inverted receptacle or indentation can be protected from erosion in a manner similar to pre-cast anodes by affixing a permeable cover, such as a screen or perforated metal plate 61, preferably made of steel, over the cast anode. Alternatively or in addition, the receptacle or indentation may comprise a permeable reinforcing metal network 62, preferably made of steel, throughout its interior. When cast into the receptacle or indentation, the metal network extends throughout the interior of the anode and provides erosion resistance.

The preceding description has been presented with reference to the presently preferred embodiment of the invention shown in the accompanying drawings. Workers skilled in the art and technology to which this invention pertains will appreciate that alterations and changes in the described apparatus and structure can be practiced without meaningfully departing from the principles, spirit and scope of this invention. For example, it is presently preferred that the anode be attached to a rock bit in the dome region. However, the anodes may be situated at other locations and function suitably. As illustrative, an anode 66 can be formed in the shape of a "washer" and positioned at the base of pin 13 as shown in FIG. 1, in electrical contact with the bit body. Such a washer-shaped sacrificial anode is particularly applicable for use with rock bits having a single leg and cutter cone.

What is claimed is:

1. A rock bit for drilling subterranean formations comprising:

a steel bit body including a dome and a plurality of legs, each leg having a journal pin;

a cutter cone mounted on each journal pin;

a cone seal at the base of each journal pin between the journal pin and cutter cone; and a sacrificial anode electrically connected to the dome of the bit body comprising a shape for diverting flow of drilling mud around the cutter cones, said anode being formed of a material less noble than steel.

2. A rock bit as claimed in claim 1 wherein the sacrificial anode comprises metal selected from the group consisting of zinc, zinc alloys, magnesium, magnesium alloys, aluminum and aluminum alloys.

3. A rock bit as claimed in claim 1 wherein the sacrificial anode comprises a metal selected from the group consisting of zinc and zinc alloys.

4. A rock bit as claimed in claim 1 further comprising a threaded metal stud extending downwardly from the dome of the rock bit, generally normal to the dome, and the sacrificial anode comprises a threaded hole and wherein the sacrificial anode is threaded onto the stud.

5. A rock bit as claimed in claim 1 wherein the sacrificial anode comprises a generally tetrahedron shape.

6. A rock bit as claimed in claim 1 wherein the sacrificial anode is generally cone-shaped.

7. A rock bit as claimed in claim 1 further comprising an inverted metal receptacle attached to the dome of the bit body and in electrical contact with the bit body and into which the sacrificial anode is cast to thereby make electrical contact between the anode and the bit body.

8. A rock bit as claimed in claim 1 further comprising a permeable reinforcing network throughout the metal of the anode.

9. A rock bit as claimed in claim 4 further comprising a permeable protective cover over the sacrificial anode having greater resistance to erosion than the metal of the anode.

10. A rock bit for drilling subterranean formations comprising:

a bit body including a dome and three legs, each leg having a journal pin;

a cutter cone mounted on each journal pin;

a cone seal at the base of each journal pin between the journal pin and cutter cone; and a sacrificial anode attached to the dome of the bit body and in electrical contact with the bit body comprising a metal less noble than the metal of the bit body and having a shape of an inverted cone or tetrahedron.

11. A rock bit as claimed in claim 10 wherein the sacrificial anode comprises a metal selected from the group consisting of zinc, zinc alloys, magnesium, magnesium alloys, aluminum and aluminum alloys.

12. A rock bit as claimed in claim 10 wherein the sacrificial anode comprises a metal selected from the group consisting of zinc and zinc alloys.

13. A rock bit as claimed in claim 10 further comprising a threaded metal stud extended downwardly from the dome of the rock bit generally normal to the dome, and the sacrificial anode comprises a threaded hole and wherein the sacrificial anode is threaded onto the stud.

14. A rock bit as claimed in claim 10 further comprising an inverted metal receptacle attached to the dome of the bit body and in electrical contact with the bit body and into which the sacrificial anode is cast to thereby provide electrical contact between the anode and the bit body.

15. A rock bit as claimed in claim 10 further comprising a permeable reinforcing network throughout the metal of the anode.

16. A rock bit as claimed in claim 10 further comprising a permeable protective cover over the anode having greater resistance to erosion than the metal of the anode.

* * * * *